US007048652B2

(12) United States Patent
Sato et al.

(10) Patent No.: US 7,048,652 B2
(45) Date of Patent: May 23, 2006

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/018,807

(22) Filed: Dec. 22, 2004

(65) Prior Publication Data

US 2005/0143194 A1 Jun. 30, 2005

(30) Foreign Application Priority Data

Dec. 26, 2003 (JP) ..... 2003-433038

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 1,517,514 A * 12/1924 Hunt ..... 473/383
4,836,552 A * 6/1989 Puckett et al. ..... 473/372
5,916,044 A * 6/1999 Shimosaka et al. ..... 473/384
D441,815 S * 5/2001 Murphy ..... D21/708
6,383,092 B1 * 5/2002 Ogg ..... 473/378
6,595,876 B1 7/2003 Kasashima et al.
2002/0086746 A1 * 7/2002 Bellinger et al. ..... 473/374

FOREIGN PATENT DOCUMENTS

JP 2001-212260 A 8/2001

* cited by examiner

*Primary Examiner*—Raeann Gorden
(74) *Attorney, Agent, or Firm*—Sughrue Mion, PLLC

(57) ABSTRACT

A golf ball of the type having a large number of convex parts projecting from the spherical surface, the convex parts assuming a round or non-round shape as viewed from above, wherein the improvement includes a large number of convex parts which are arranged such that the upper surface of the convex part has a certain radius of curvature and coincides with a hypothetical spherical surface covering the spherical surface, at least part of a large number of convex parts form a string of convex parts connected to each other through a part thereof, and the strings of convex parts form at least one great circle which is substantially continuous on the spherical surface. This golf ball is novel in appearance and excellent in flight performance.

15 Claims, 6 Drawing Sheets

GOLF BALL

CROSS-REFERENCE TO RELATED APPLICATION

This non-provisional application claims priority under 35 U.S.C. §119(a) on Patent Application No. 2003-433038 filed in Japan on Dec. 26, 2003, the entire contents of which are hereby incorporated by reference.

BACKGROUND OF THE INVENTION

The present invention relates to a golf ball which is novel in appearance and excellent in flight performance.

It is known well that a golf ball should have a high rebound resilience and a low aerodynamic resistance during its flight (due to dimples arranged on its surface) if it is to attain a long flying distance after strike. For reduction of aerodynamic resistance, there have been proposed several methods for arranging dimples on the ball surface as densely and uniformly as possible.

Ordinary dimples are round dents as viewed from above. If such round dimples are to be densely arranged, it is necessary to narrow down the flat part (land part) separating adjoining dimples from each other. Even though the flat part is infinitely narrow, there still exists a triangular or rectangular flat part of certain size in the area surrounded by three or four dimples. On the other hand, it is essential to arrange dimples as uniformly as possible on the ball's spherical surface. This necessitates making a compromise between the density and the uniformity of dimple arrangement.

One conventional way to achieve the object of arranging dimples densely and uniformly was to arrange two to five kinds of dimples differing in diameter assuming that the ball's spherical surface is a regular octahedron or icosahedron. (See Japanese Patent Laid-open No. 2001-212260, for example).

However, as far as dimples are round, the total area of dimples practically accounts for only 75% or so in the surface area of the sphere, with the remainder (25%) being the area of flat parts (land parts). For this reason, it has been required to increase the ratio of the total area of dimples accounting for in the total spherical surface area in order to reduce further the aerodynamic resistance during flight due to dimples arranged on the ball surface.

SUMMARY OF THE INVENTION

The present invention was completed in view of the foregoing. It is an object of the present invention to provide a golf ball which is novel in surface design and excellent in flight performance.

After a series of researches, the present inventors found that the above-mentioned object is achieved by a golf ball of the type having a large number of convex parts projecting from the spherical surface, the convex parts assuming a round or non-round shape as viewed from above, wherein the improvement includes a large number of convex parts which are arranged such that the upper surface of the convex part has a certain radius of curvature and coincides with a hypothetical spherical surface covering the spherical surface, at least part of a large number of convex parts form a string of convex parts connected to each other through a part thereof, and the strings of convex parts form at least one great circle which is substantially continuous on the spherical surface. This golf ball is excellent in flight performance and has a novel appearance with unconventional dimples.

The golf ball according to the present invention is excellent in flight performance and has a novel surface design.

DETAILED DESCRIPTION OF THE PREFERRED EMBODIMENTS

The golf ball according to the present invention will be described in more detail with reference to the accompanying drawings.

EXAMPLE 1

Figure 1:
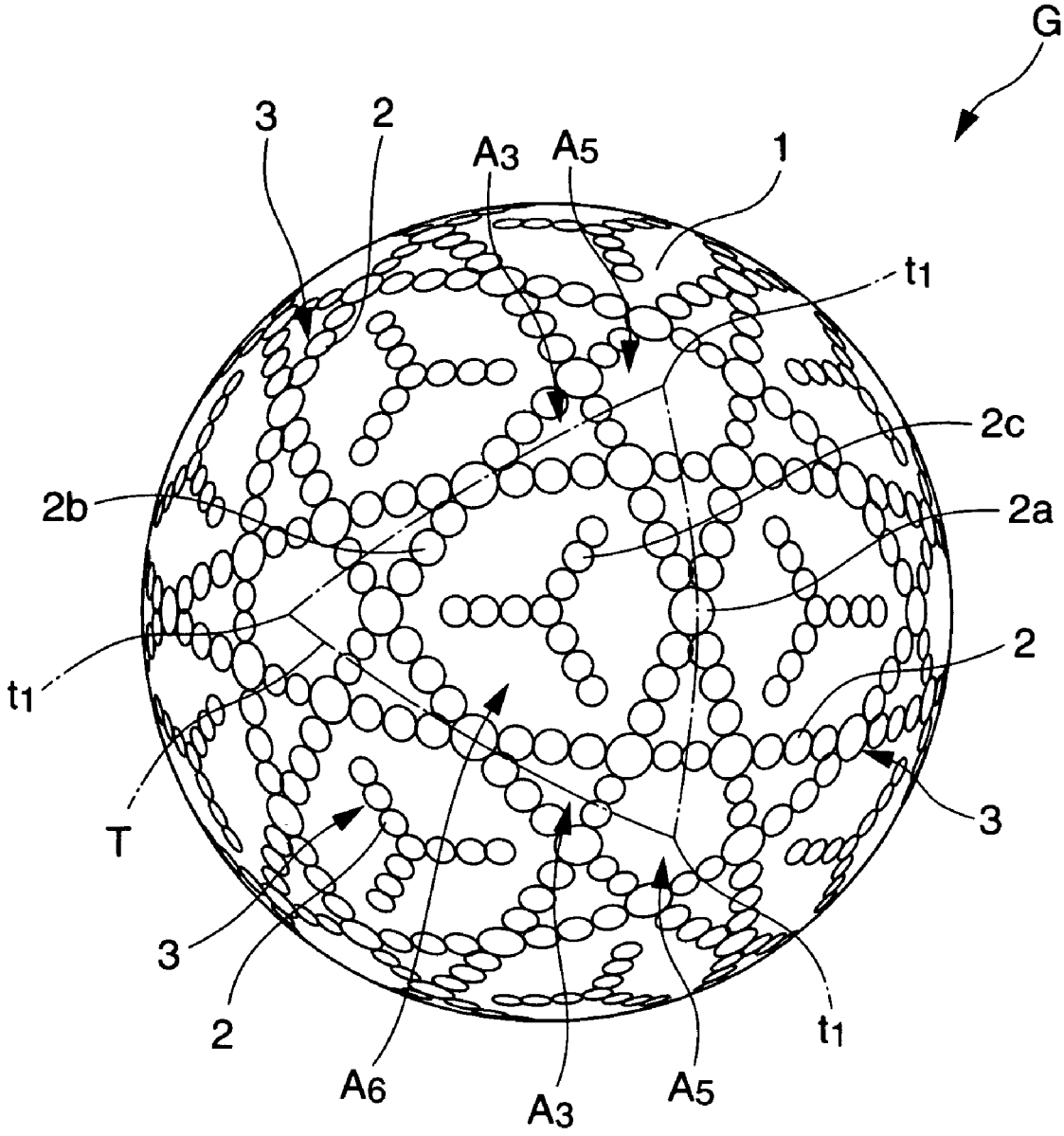
FIG. 1 is a schematic plan view of the golf ball in Example 1.
Figure 6:
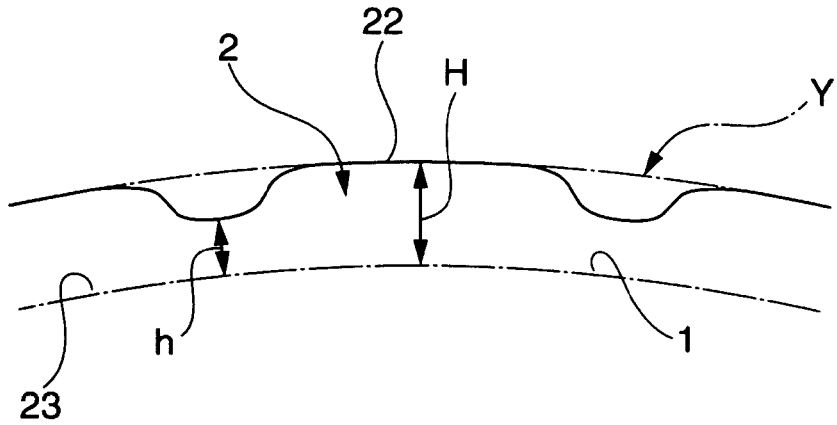
FIG. 6 is a longitudinal sectional view taken along the center line X shown in FIG. 5.

FIG. 1 is a plan view of the golf ball in Example 1. Referring to FIG. 1, there is shown a golf ball G of the present invention which has on the spherical surface a number of convex parts 2 which are round or non-round as viewed from above. Each of the convex parts 2 has a curved upper surface 22 with a certain radius of curvature which coincides with the hypothetical spherical surface covering the ball surface (See FIG. 6). The convex parts 2 are formed such that at least part of them connect with each other to form something like a string of beads 3, which constitutes at least one great circle practically connecting with other great circles on the spherical surface.

Although the convex parts 2 are round ones in Example 1, they may take on any non-round shape, such as ellipse, elongated circle, triangle, square, pentagon, hexagon, and octagon.

Figure 2:
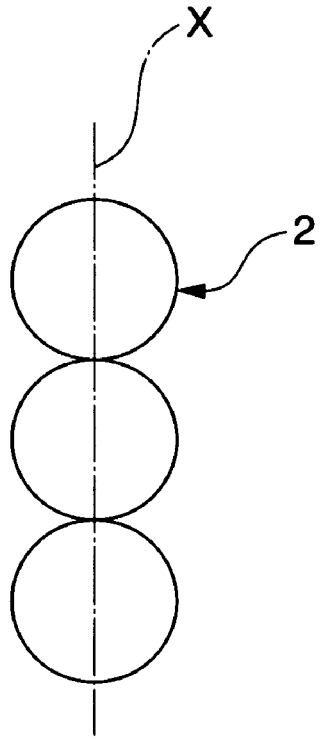
FIG. 2 is a partly enlarged view showing the convex parts in Example 1.
Figure 3:
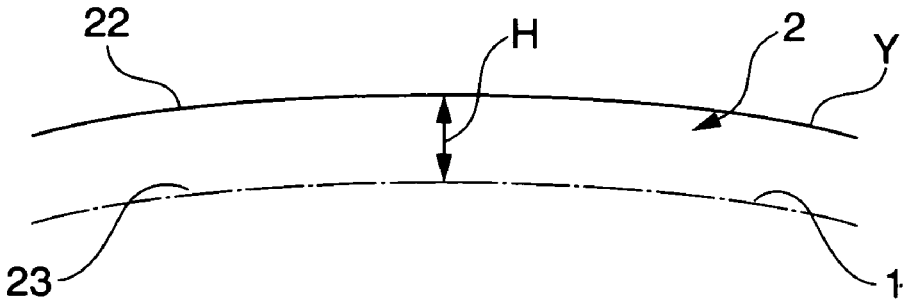
FIG. 3 is a longitudinal sectional view taken along the center line X shown in FIG. 2.
Figure 4:
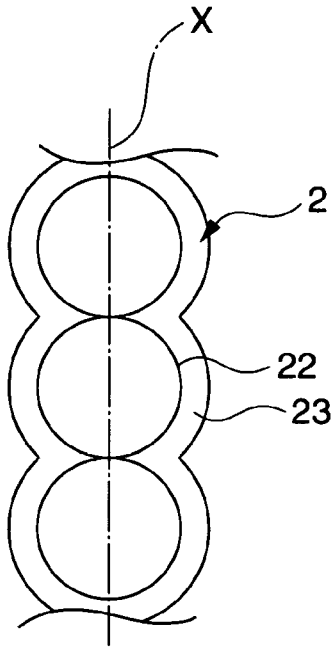
FIG. 4 is a partly enlarged view of the convex parts arranged differently than those in Example 1.

FIG. 2 is a partly enlarged view showing the convex parts 2 which form something like a string of beads. FIG. 3 is a longitudinal sectional view taken along the center line X of the convex parts shown in FIG. 2. In this example, each convex part 2 is substantially a cylindrical object projecting from the spherical surface 1, and the upper surface 22 and the lower surface 23 of the convex part 2 has the same diameter. A large number of convex parts 2 extend contiguously on the spherical surface to form a great circle. Therefore, the cross section of the convex parts along the center line X has the height H and forms a great circle as shown in FIG. 3. Incidentally, each convex part 2 may be formed such that the lower surface 23 has a larger diameter than the upper surface 22, as shown in FIG. 4. The convex parts 2 shown in FIG. 4 are formed such that their upper surfaces are joined together and hence their sectional view looks as though they form a ridge with a uniform height of H.

Figure 5:
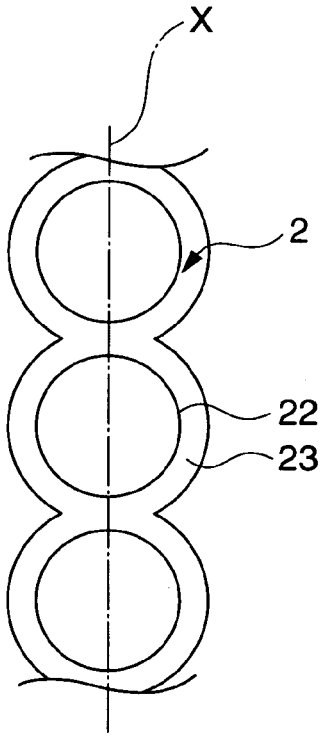
FIG. 5 is a partly enlarged view of the convex parts arranged differently than those in Example 1.

FIG. 5 shows the arrangement of the convex parts in another embodiment. Each convex part is formed such that the diameter increases in going from the upper surface 22 to the lower surface 23. The adjacent lower surfaces 23 join with each other, but the adjacent upper surfaces 22 are separate from each other with certain intervals. The longitudinal sectional view in FIG. 6 looks like a continuous wavy pattern which results from difference between the height H of the upper surface 22 and the height h of the lower surface 23. In this case, the thickness (or the height h) of the lower surface 23 should preferably be no lower than 3% and no higher than 35% of the thickness (or the height H) of the upper surface 22.

In FIG. 1, one unit triangle T is indicated by one-dot chain lines. This unit triangle T is a constituent unit of the spherical icosahedron. In this example, eight strings of convex parts 3 are formed such that two strings cross each other at the center of each side (indicated by a one-dot chain line) of the unit triangle T. A comparatively large convex part 2*a* is arranged at the position where two strings of convex part 3 cross each other, and it partly functions as the convex parts 2 constituting the string of convex parts 3.

The strings of convex parts 3, which extend along the great circle, forms a hexagonal area A6 in the unit triangle T (The center of the unit triangle T coincides with the center of the hexagonal area A6.). Moreover, the strings of convex parts 3 form a pentagonal area A5 (Each apex of the unit triangle T coincides with the center of the pentagonal area A5.). Further, the strings of convex parts 3 form two isosceles triangular areas A3 symmetrically on each side of the unit triangle T. One convex part 2 is placed at the center of the hexagonal area A6 and three each of the convex parts 2 are placed in the hexagonal area A6 such that they extend from the center toward each vertex t1 of the unit triangle. Thus the three strings of the convex parts form a Y-shape.

The height of the convex part 2 (the height H in FIGS. 3 and 6) should preferably be in the range of 0.01 to 0.2 mm. The diameter of the convex part 2 should preferably be in the range of 1.0 to 4.0 mm (The diameter is that at the maximum position, and in the case of polygon, the diameter is that of its circumscribed circle.). In Example 1 shown in FIG. 1, the diameter of the convex part 2 varies as follows. The convex part 2*a* arranged at the position where two strings of convex parts 3 cross each other has the largest diameter of 2.5 mm. The convex part 2*b* arranged between two convex parts 2*a* has the second largest diameter of 1.9 mm. The convex parts 2*c* arranged on the Y-shaped pattern in the hexagonal area has the smallest diameter of 1.6 mm.

The convex part 2 should preferably vary in size from 2 to 10 kinds.

According to the present invention, the diameter of the golf ball is measured by regarding the line connecting the upper surfaces of the convex parts (shown in FIG. 3) as the reference or by regarding the arc Y (one-dot chain line) connecting the upper surfaces of the convex parts (shown in FIG. 6) as the reference.

EXAMPLE 2

Figure 7:
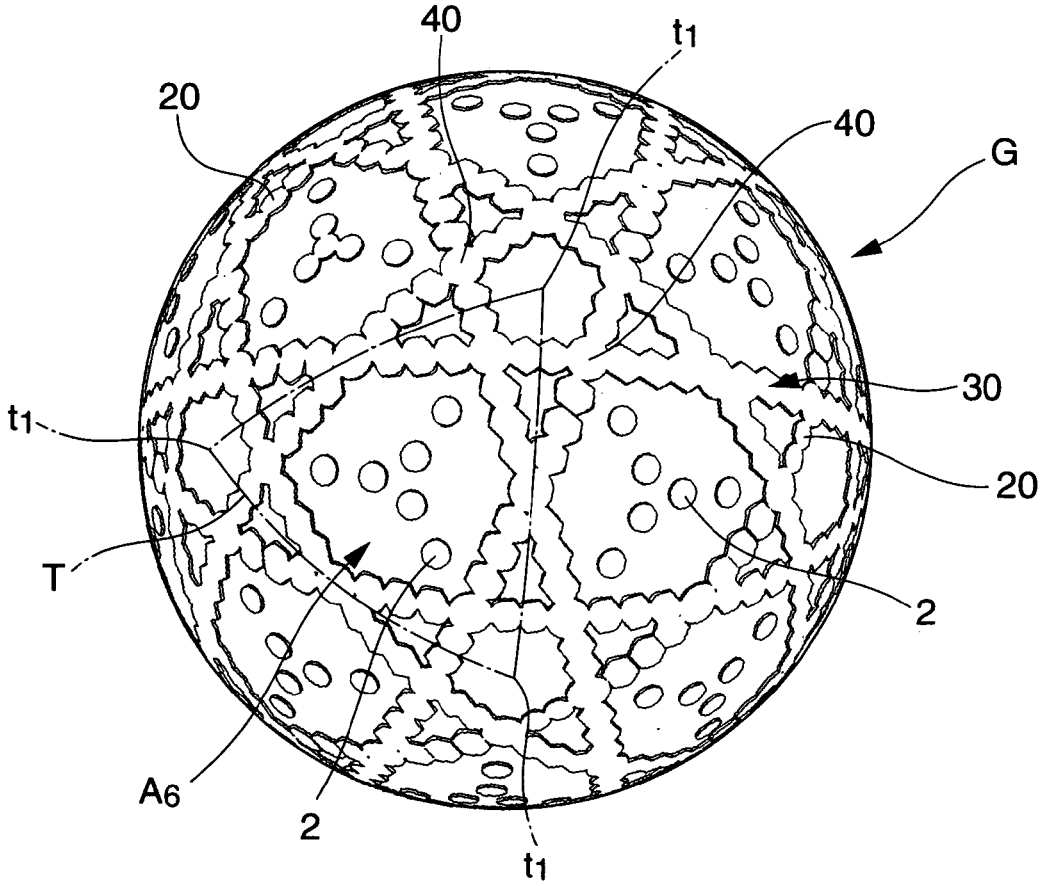
FIG. 7 is a schematic plan view of the golf ball in Example 2.

FIG. 7 is a plan view of the golf ball in Example 2 of the present invention.

Figure 8:
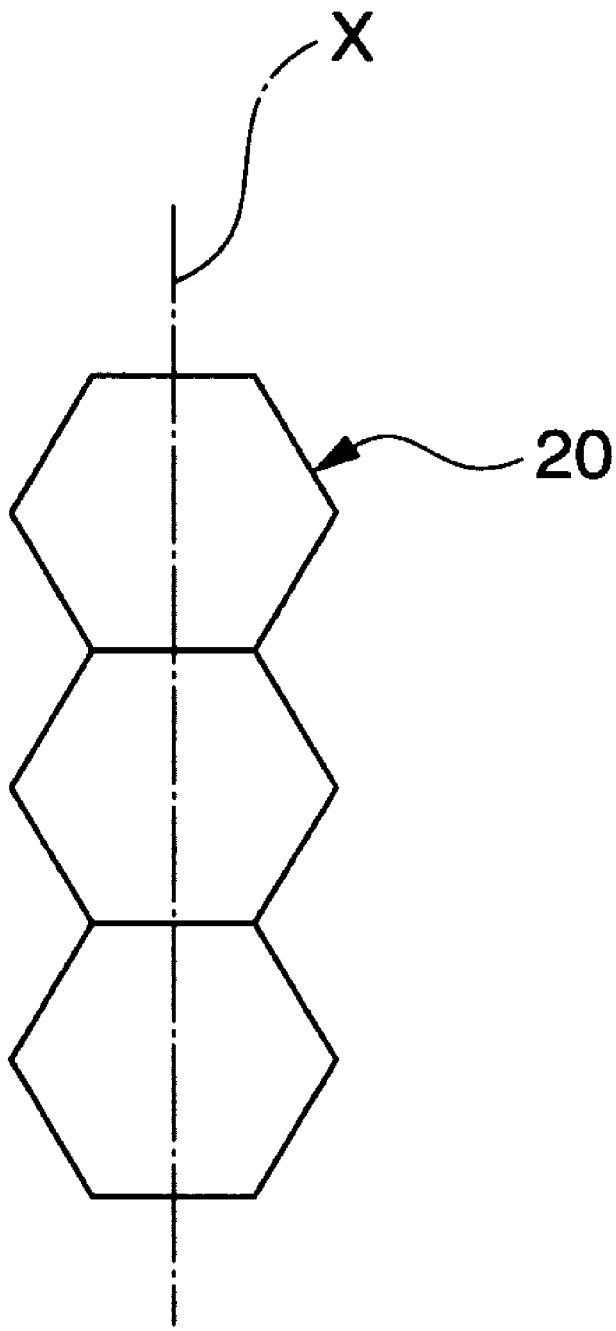
FIG. 8 is a partly enlarged view of hexagonal convex parts in Example 2.

This example differs from Example 1 in that hexagonal convex parts 20 (as constituents for the string of convex parts extending along a great circle) are used in place of round convex parts. As shown in FIG. 8, a plurality of hexagonal convex parts 20 join together to form a string. A round convex part 40 is formed at the position where two strings cross each other. The longitudinal cross section along the centerline X (shown in FIG. 8) is an endless contour depicted by the upper surfaces, as in Example 1 (See FIG. 3). Moreover, six round convex parts 2 are arranged in a Y-shape pattern within the hexagonal area A6 surrounded by the unit triangle T.

EXAMPLE 3

Figure 9:
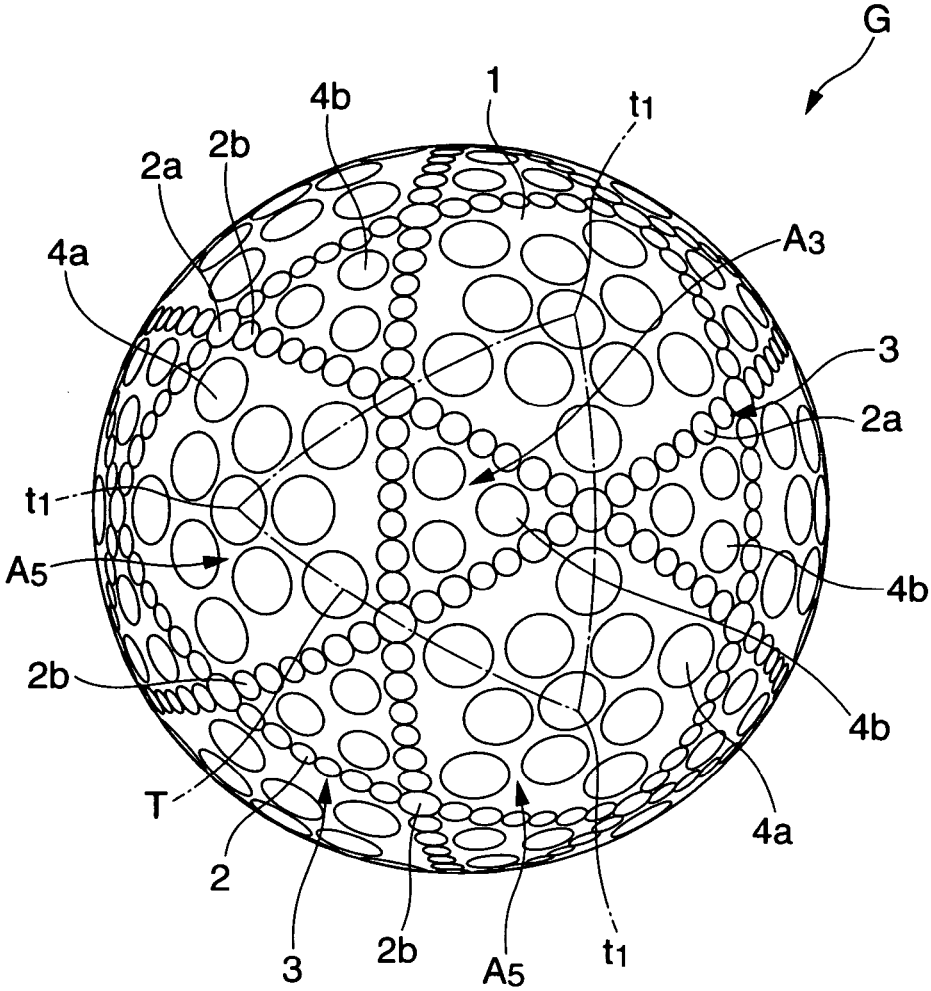
FIG. 9 is a schematic plan view of the golf ball in Example 3.

FIG. 9 is a plan view of the golf ball in Example 3 of the present invention.

In this example, the strings of convex parts 3 are arranged in conformity with the unit triangle T (indicated by one-dot chain lines) which is the constituent of the spherical icosahedron, as in Example 1. This example differs from Example 1 in that seven strings of convex parts 3 are arranged along great circles. The strings of convex parts 3 are arranged such that two of them cross each other at the center of each side of the unit triangle T constituting the spherical icosahedron. These strings of convex parts 3 substantially divides the unit triangle T into four small triangular areas A3. The strings of convex parts 3 are arranged as mentioned above in the remaining 19 unit triangles which are not shown.

Also, five convex parts 3 form a pentagonal area A5, with its center coinciding with each apex t1 of the unit triangle. Owing to this arrangement, a plurality of concave parts are arranged adequately in the four small triangular areas. Round concave parts 4*a* (with a comparative large diameter) are used in the pentagonal area A5. One concave part 4*a* is placed, with its center coinciding with the apex t1 of the unit triangle. Five concave parts 4*a* are placed around the concave part 4*a*. One each of the concave part is placed at the apex of the pentagon. Thus, eleven concave parts 4*a* in total are arranged. At the center of the unit triangle T is arranged a small triangular area A3 surrounded by three sides each composed of a string of convex parts. Within the small triangular area are arranged three concave parts 4*b* (with a comparatively smaller diameter than the concave part 4*a*) at certain intervals.

The diameter of the concave part 4 should preferably be in the range of 2 to 5 mm, particularly 2.5 to 4.5 mm. The concave part 4 should preferably vary in size from 2 to 10 kinds, although two kinds (large and small) are shown in this example. Also, the concave part 4 should preferably vary in shape (diameter and/or depth) from 2 to 10 kinds.

Figure 10:
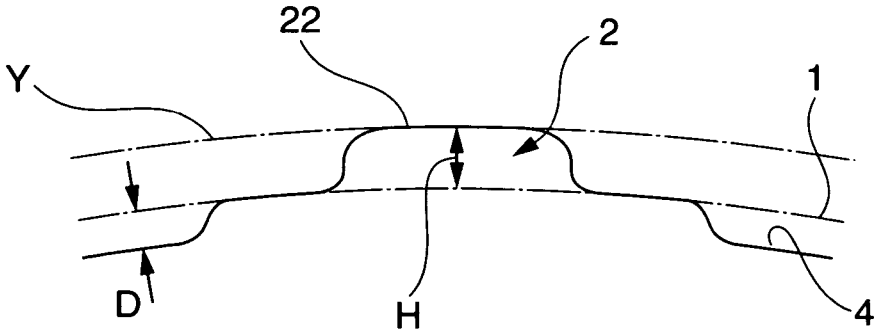
FIG. 10 is a side view of the string of convex parts in Example 3.

FIG. 10 is a side view of the string of convex parts in this example. In FIG. 10, the diameter of the golf ball is measured by regarding as the reference the hypothetical spherical surface Y (indicated by a one-dot chain line) formed by connecting the upper surfaces 22 of the convex parts 2. The diameter is selected according to the Golf Rule. The maximum depth D of the concave part 4 should be in the range of 0.01 to 0.2 mm (from the spherical surface 1 indicated by a one-dot chain line).

The scope of the present invention is not limited to that explained above with reference to Examples 1 to 3. Variations and modifications will be made without departing from the spirit of the present invention. For example, the pattern of the strings of convex parts 3 extending along great circles is not limited to that (eight strings) shown in FIG. 1. As many strings as necessary may be formed. Also, the convex parts 3 may be arranged continuously or intermittently along great circles. Alternatively, it is also possible to combine together continuous strings and intermittent strings.

The arrangement of convex parts 3 may be made by dividing the ball surface into a polyhedron (such as octahedron and dodecahedron) as well as icosahedron (in Examples 1 to 3).

The strings of convex parts 3 extending along great circles divides the ball surface into small areas. In Examples 1 and 2 (shown in FIGS. 1 and 7), only convex pars 2 are arranged in these small areas, whereas in Example 3 (shown in FIG. 9), only concave parts 4 are arranged in these small areas. Alternatively, it is also possible to combine convex parts 2 and concave parts 4 alternately. Moreover, it is also possible to use convex parts 2 and concave parts 4 having the same or different diameters. The convex parts 2 and concave parts 4 are not limited to round ones; they may be polygonal or non-round.

The present invention may be applicable to golf ball of any type (structure) such as, one-piece golf ball, two-piece golf ball, multi-piece golf ball (with three or more layers), and thread-wound golf ball. The golf ball of the present invention can be formed in the usual way from any known material. The weight and diameter of the golf ball may be properly established according to the Golf Rules.

Japanese Patent Application No. 2003-433038 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball of the type having a large number of convex parts projecting from the spherical surface, said convex parts assuming a round or non-round shape as viewed from above, wherein the improvement comprises the large number of convex parts being arranged such that an upper surface of each of the convex parts has a certain radius of curvature and coincides with a hypothetical spherical surface covering said spherical surface, at least part of the large number of convex parts form strings of convex parts connected to each other through a part thereof, and the strings of convex parts form at least one great circle which is substantially continuous on the spherical surface;

wherein more than one of the strings of convex parts are formed such that they cross each other to form polygonal areas each consisting of small areas;

wherein the areas divided by the strings of convex parts have concave parts arranged therein which assume a round or non-round shape as viewed from above.

2. The golf ball of claim 1, wherein the areas divided by the strings of convex parts have convex parts arranged therein which assume a round or non-round shape as viewed from above.

3. The golf ball of claim 1, wherein the concave parts have depths ranging from 0.01 to 0.2 mm.

4. The golf ball of claim 1, wherein more than one of the strings of convex parts are arranged in conformity with a spherical icosahedron, dodecahedron, or octahedron.

5. A golf ball of the type having a large number of convex parts projecting from the spherical surface, said convex parts assuming a round or non-round shape as viewed from above, wherein the improvement comprises the large number of convex parts being arranged such that an upper surface of each of the convex parts has a certain radius of curvature and coincides with a hypothetical spherical surface covering said spherical surface, at least part of the large number of convex parts form strings of convex parts connected to each other through a part thereof, and the strings of convex parts form at least one great circle which is substantially continuous on the spherical surface; and wherein the convex parts have heights ranging from 0.01 to 0.2 mm.

6. The golf ball of claim 5, wherein more than one string of convex parts are formed such that they cross each other to form polygonal areas each consisting of small areas.

7. The golf ball of claim 6, wherein at the position where two strings of the convex parts cross each other, a comparatively large convex part is arranged.

8. The golf ball of claim 5, wherein said convex parts are formed in the shape of at least one of an ellipse, elongated circle, triangle, square, pentagon, hexagon, and octagon.

9. The golf ball of claim 5, wherein each of the convex parts is a substantially cylindrical object projecting from the spherical surface.

10. The golf ball of claim 5, wherein said convex parts are formed such that their upper surfaces are joined together so that in a sectional view, the upper surfaces form a ridge with a uniform height.

11. The golf ball of claim 5, wherein said convex parts are formed such that the diameter of said radius of curvature increases in going from the upper surface to the lower surface and the adjacent lower surfaces join with each other, but the adjacent upper surfaces are separate from each other.

12. The golf ball of claim 11, wherein said convex parts have a height H of the upper surface and a height h of the lower surface from said spherical surface and said height h is no lower than 3% and no higher than 35% of said height H.

13. The golf ball of claim 5, wherein said convex parts have a diameter in the range of 1.0 to 4.0 mm, where the diameter is that at the maximum position, and in the case of polygon, the diameter is that of its circumscribed circle.

14. The golf ball of claim 5, wherein said convex parts vary in size from 2 to 10 kinds.

15. The golf ball of claim 5, wherein more than one of the strings of convex parts are arranged in conformity with a spherical icosahedron, dodecahedron, or octahedron.

* * * * *